US009197979B2

(12) United States Patent
Lemieux et al.

(10) Patent No.: US 9,197,979 B2
(45) Date of Patent: Nov. 24, 2015

(54) OBJECT-BASED AUDIO SYSTEM USING VECTOR BASE AMPLITUDE PANNING

(71) Applicant: DTS LLC, Calabasas, CA (US)

(72) Inventors: Pierre-Anthony Stivell Lemieux, San Mateo, CA (US); Roger Wallace Dressler, Bend, CA (US); Jean-Marc Jot, Aptos, CA (US)

(73) Assignee: DTS LLC, Calabasas, CA (US)

( * ) Notice: Subject to any disclaimer, the term of this patent is extended or adjusted under 35 U.S.C. 154(b) by 285 days.

(21) Appl. No.: 13/906,214

(22) Filed: May 30, 2013

(65) Prior Publication Data

US 2013/0329922 A1 Dec. 12, 2013

Related U.S. Application Data

(60) Provisional application No. 61/654,011, filed on May 31, 2012.

(51) Int. Cl.
*H04S 7/00* (2006.01)
*H04S 3/00* (2006.01)

(52) U.S. Cl.
CPC . *H04S 7/30* (2013.01); *H04S 3/002* (2013.01); *H04S 7/301* (2013.01); *H04S 2400/11* (2013.01)

(58) Field of Classification Search
CPC ..... H04S 7/30; H04S 7/301; H04S 3/00; H04S 3/002; H04S 3/004; H04S 2400/11
USPC ..... 381/307, 300, 303, 310, 19, 22, 23
See application file for complete search history.

(56) References Cited

U.S. PATENT DOCUMENTS 5,598,478 A * 1/1997 Tanaka et al. ..... 381/17
7,734,362 B2 * 6/2010 Roeder et al. ..... 700/94
8,165,326 B2 * 4/2012 Ohashi ..... 381/310
2007/0269063 A1 11/2007 Goodwin et al.

(Continued)

FOREIGN PATENT DOCUMENTS

WO WO 2007/136187 A1 11/2007

OTHER PUBLICATIONS

Ando, et al. 2009 "Sound intensity based three-dimensional panning" *Audio Engineering Society Convention Paper 7675* in 9 pages.

(Continued)

*Primary Examiner* — Xu Mei
*Assistant Examiner* — Jason R Kurr
(74) *Attorney, Agent, or Firm* — Knobbe Martens Olson & Bear LLP

(57) ABSTRACT

Methods and systems of reproducing object-based audio are disclosed. In some embodiments, vector base amplitude panning (VBAP) is used for playing back an object's audio. Using the positioning of sound reproduction devices and object's location information, rendering can determine which sound reproduction devices are used for playing back the object's audio. For example, a triangle in which the object is positioned at a given time can be identified. The triangle can have sound reproduction devices as vertices, and the object's audio can be rendered on the sound reproduction devices corresponding to the vertices of the triangle. In some embodiments, ambiguities associated with VBAP-based rendering are identified and resolved.

19 Claims, 10 Drawing Sheets

(56) References Cited

U.S. PATENT DOCUMENTS

| | | | | |
|---|---|---|---|---|
| 2008/0037796 | A1 | 2/2008 | Jot et al. | |
| 2010/0119092 | A1 * | 5/2010 | Kim et al. | 381/306 |

OTHER PUBLICATIONS

Faller, et al. 2010 "Acoustic Performance of an Installed Real-Time Three-Dimensional Audio System" *Proceedings of Meetings on Acoustics* 11; 1-13.

M. Gerzon 1992 "Panpot Laws for Multispeaker Stereo" *Audio Engineering Society Convention Paper 3306* in 64 pages.

M. Gerzon 1992 "General Metatheory of Auditory Localization" *Audio Engineering Society Convention Paper 3309* in 40 pages.

Jot, et al. "A Comparative Study of 3-D Audio Encoding and Rendering Techniques" *16th International Conference: Spatial Sound Reproduction* in 20 pages.

Pulkki, et al. 1998 "Creating auditory displays with multiple loudspeakers using VBAP: a case study with DIVA project" *Laboratory of Acoustics and Audio Signal Processing* in 7 pages.

Pulkki, et al. 1997 "Virtual sound source positioning using vector base amplitude panning" *Journal of the Audio Engineering Society*, 45(6), pp. 456-466.

Pulkki, et al. 2001 "Localization of amplitude-panned virtual sources I: stereophonic panning" *Journal of the Audio Engineering Society*, 49(9), pp. 739-752.

Sadek, et al. 2004 "A Novel Multichannel Panning Method for Standard and Arbitrary Loudspeaker Configurations" *Audio Engineering Society Convention Paper 6263* in 5 pages.

International Search Report and Written Opinion for International Application No. PCT/US2013/043150 mailed on May 12, 2014 in 12 pages.

* cited by examiner

OBJECT-BASED AUDIO SYSTEM USING VECTOR BASE AMPLITUDE PANNING

RELATED APPLICATIONS

This application claims the benefit of priority under 35 U.S.C. §119(e) of U.S. Provisional Application No. 61/654,011, filed on May 31, 2012, and entitled "Object-Based Audio System Using Vector Base Amplitude Panning," the disclosure of which is hereby incorporated by reference in its entirety.

BACKGROUND

Existing audio distribution systems, such as stereo and surround sound, are based on an inflexible paradigm implementing a fixed number of channels from the point of production to the playback environment. Throughout the entire audio chain, there has traditionally been a one-to-one correspondence between the number of channels created and the number of channels physically transmitted or recorded. In some cases, the number of available channels is reduced through a process known as downmixing to accommodate playback configurations with fewer reproduction channels than the number provided in the transmission stream. Common examples of downmixing are mixing stereo to mono for reproduction over a single speaker and mixing multi-channel surround sound to stereo for two-speaker playback.

Typical channel-based audio distribution systems are also unsuited for 3D video applications because they are incapable of rendering sound accurately in three-dimensional space. These systems are limited by the number and position of speakers and by the fact that psychoacoustic principles are generally ignored. As a result, even the most elaborate sound systems create merely a rough simulation of an acoustic space, which does not approximate a true 3D or multi-dimensional presentation.

SUMMARY

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught herein without necessarily achieving other advantages as can be taught or suggested herein.

In some embodiments, a method of reproducing object-based audio includes receiving, with a receiver comprising one or more processors, an audio object comprising audio and position information. The method further includes determining, for a plurality of sound reproduction devices, one or more audio reproducing parameters using modified vector base amplitude panning (VBAP). Determining one or more audio reproducing parameters includes, using the position information, determining a plurality of overlapping triangles in which a virtual sound source for the audio object is positioned. The vertices of each triangle in the plurality of triangles correspond to sound reproduction devices. The method further includes determining the one or more audio reproducing parameters for a set of sound reproduction devices corresponding to the vertices of the plurality of triangles, and using the one or more audio reproducing parameters, reproducing the audio on the plurality of sound reproduction devices such that the audio appears to emanate from the virtual sound source.

The method of the preceding paragraph may also include any combination of the following features described in this paragraph, among others described herein. For instance, audio reproducing parameters are gain factors, and determining the one or more audio reproducing parameters includes combining the gain factors corresponding to the plurality of triangles; combining the gain factors includes averaging the gain factors; the plurality of triangles includes two triangles, and reproducing the audio on the plurality of sound reproduction devices includes playing back the audio on the sound reproduction devices corresponding to the vertices of the two triangles at sound intensity levels corresponding to the averaged gain factors. As another example, the plurality of sound reproduction devices is selected from the group consisting of loudspeakers and headphones; the plurality of sound reproduction devices include a plurality of loudspeakers, and at least some loudspeakers are elevated with respect to a position of a listener.

In certain embodiments, a method of reproducing object-based audio includes determining, for a plurality of sound reproduction devices, one or more audio reproducing parameters by determining a position of a virtual sound source for the audio object, and determining a first plurality of triangles in which the virtual sound source is positioned. The vertices of each triangle in the first plurality of triangles correspond to sound reproduction devices. The method further includes determining a position of a virtual sound reproduction device, determining a second plurality of triangles, the vertices of each triangle in the second plurality of triangles corresponding to sound reproduction devices from the first plurality of triangles and the virtual sound reproduction device, and determining the one or more audio reproducing parameters for a set of sound reproduction devices corresponding to the vertices of the second plurality of triangles. The method can be performed by one or more processors.

The method of the preceding paragraph may also include any combination of the following features described in this paragraph, among others described herein. For example, the method may include receiving, with a receiver including one or more processors, the audio object including audio, and using the one or more audio reproducing parameters, reproducing the audio on the set of sound reproduction devices such that the audio appears to emanate from the virtual sound source; the second plurality of triangles includes four triangles, each having the virtual sound reproduction device as a vertex, and determining the one or more audio reproducing parameters includes determining gain factors corresponding to the vertices of the four triangles; determining the gain factors corresponding to the vertices of the four triangles includes combining the gain factors for each of the triangles to determine the gain factors corresponding to the non-virtual vertices of the four triangles, and reproducing the audio on the set of sound reproduction devices includes playing back the audio on the sound reproduction devices corresponding to non-virtual vertices of the triangles. As another example, at least some triangles in the first plurality of triangles are overlapping, and the triangles in the second plurality of triangles are not overlapping; determining the position of the virtual sound reproduction device includes determining an intersection point of the sides of two triangles in the first plurality of triangles.

In various embodiments, an apparatus for reproducing object-based audio includes a receiver comprising one or more processors, the receiver configured to receive an audio object comprising audio and position information. The apparatus also includes a render configured to, for a plurality of sound reproduction devices, determine, using the position information, a plurality of overlapping triangles in which a virtual sound source for the audio object is positioned. The vertices of each triangle in the plurality of triangles correspond to sound reproduction devices. The renderer is also configured to determine the one or more audio reproducing parameters for a set of sound reproduction devices corresponding to the vertices of the plurality of triangles, and using the one or more audio reproducing parameters, reproduce the audio on the plurality of sound reproduction devices such that the audio appears to emanate from the virtual sound source.

The apparatus of the preceding paragraph may also include any combination of the following features described in this paragraph, among others described herein. For instance, audio reproducing parameters include gain factors, and the renderer is configured to determine the one or more audio reproducing parameters by combining the gain factors corresponding to the plurality of triangles; the renderer is further configured to average the gain factors; the plurality of triangles includes two triangles, and the renderer is further configured to play back the audio on the sound reproduction devices corresponding to the vertices of the two triangles at sound intensity levels corresponding to the averaged gain factors. As another example, the plurality of sound reproduction devices is selected from the group consisting of loudspeakers and headphones; the plurality of sound reproduction devices comprise a plurality of loudspeakers, and wherein at least some loudspeakers are elevated with respect to a position of a listener.

In some embodiments, an apparatus for reproducing object-based audio includes a renderer comprising one or more processors, the renderer configured to determine a position of a virtual sound source for the audio object, and, for a plurality of sound reproduction devices, determine a first plurality of triangles in which the virtual sound source is positioned. The vertices of each triangle in the first plurality of triangles correspond to sound reproduction devices. The renderer is also configured to determine a position of a virtual sound reproduction device, determine a second plurality of triangles, the vertices of each triangle in the second plurality of triangles corresponding to sound reproduction devices from the first plurality of triangles and the virtual sound reproduction device, and determine the one or more audio reproducing parameters for a set of sound reproduction devices corresponding to the vertices of the second plurality of triangles.

The apparatus of the preceding paragraph may also include any combination of the following features described in this paragraph, among others described herein. For example, the apparatus may include a receiver configured to receive the audio object including audio, wherein the renderer is further configured to reproduce the audio, using the one or more audio reproducing parameters, on the set of sound reproduction devices such that the audio appears to emanate from the virtual sound source; the second plurality of triangles includes four triangles, each having the virtual sound reproduction device as a vertex, and the renderer is configured to determine the one or more audio reproducing parameters by determining gain factors corresponding to the vertices of the four triangles; the renderer is further configured to determine the gain factors corresponding to the non-virtual vertices of the four triangles by combining the gain factors for each of the triangles, and play back the audio on the sound reproduction devices corresponding to non-virtual vertices of the triangles; the receiver is configured to receive the audio object comprising video game audio from a gaming device, and the gaming device is not aware of a positioning of the plurality of sound reproduction devices with respect to a listener. As another example, at least some triangles in the first plurality of triangles are overlapping, and the triangles in the second plurality of triangles are not overlapping; the renderer is further configured to determine the position of the virtual sound reproduction device by determining an intersection point of the sides of two triangles in the first plurality of triangles.

In some embodiments, an apparatus for reproducing object-based audio includes a receiver configured to receive an audio object that includes video game audio from a gaming device in proximity with the receiver. The apparatus further includes a renderer having one or more processors, the renderer configured to determine a position of a virtual sound source for the audio object based on metadata encoded in the audio object and reproduce the video game audio on a plurality of sound reproduction devices such that the audio appears to emanate from the virtual sound source. The audio object can be configured for reproduction of the audio such that the audio appears to emanate from the virtual sound source irrespective of a positioning of the plurality of sound reproduction devices with respect to a listener.

BRIEF DESCRIPTION OF THE DRAWINGS

Throughout the drawings, reference numbers are re-used to indicate correspondence between referenced elements. The drawings are provided to illustrate embodiments of the inventions described herein and not to limit the scope thereof.

DESCRIPTION OF EMBODIMENTS

I. Introduction

Figure 1:
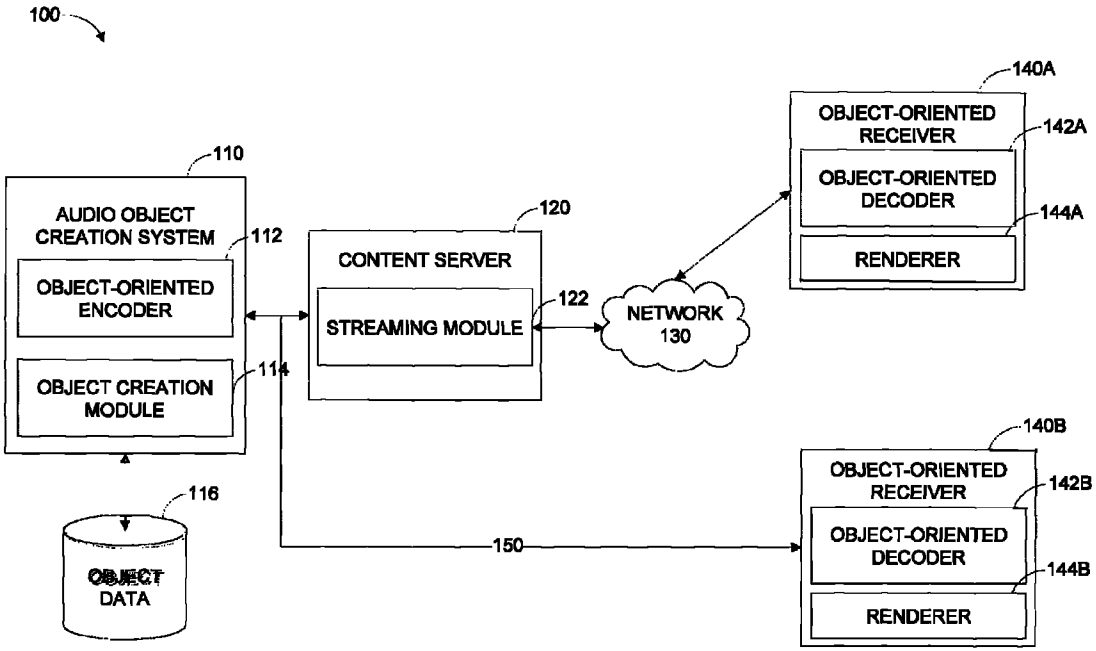
FIG. 1 illustrates an embodiment of an object-based audio system.

Systems and methods for providing object-based audio (sometimes referred to herein as Multi-Dimensional Audio (MDA)) are described. In certain embodiments, audio objects are created by associating sound sources with attributes or properties of those sound sources, such as location, trajectory, velocity, directivity, and the like. Audio objects can be used in place of or in addition to audio channels to distribute sound, for example, by streaming the audio objects over a network to a receiving device or user device or by transmitting the audio objects from one device to another. The objects can be adaptively streamed to the receiving device based on available network or receiving device resources. Position and trajectory information of audio objects can be defined in space using two or three dimensional coordinates. A renderer on the receiving device can use the attributes of the objects to determine how to render the objects. The renderer can further adapt the playback of the objects based on information about a rendering environment of the receiving device.

Any of a variety of techniques can be used to perform the mapping or rendering of objects to one or more audio channels or to a bit stream or distribution stream that represents audio data of an object, with each audio channel intended for playback by one or more sound reproduction devices at a receiver. Some embodiments employ Vector-Base Amplitude Panning (VBAP) as described in Pulkki, V., "Virtual Sound Source Positioning Using Vector Base Amplitude Panning," J. Audio Eng. Soc., Vol. 45, No. 6, June 1997, which is hereby incorporated by reference in its entirety. Rendering based on VBAP makes it possible to position virtual sound sources in two-dimensional or three-dimensional spaces using any configuration of sound reproduction devices, such as loud speakers, sound bars, headphones, directional headphones, etc. Sound reproduction devices may play back any number of channels, such as a mono channel, or a stereo set of left and right channels, or surround sound channels. For example, sound reproduction devices can be arranged in 5.1, 6.1, 7.1, 9.1, 11.1, etc. surround sound configurations. In some embodiments, other panning techniques or other rendering techniques may be used for audio objects in addition to or instead of VBAP.

In some embodiments, an object's audio data (sometimes referred to herein as audio essence) and/or information encoded in the object's metadata can be used to determine which sound reproduction device or sound reproduction devices to render the object on. For instance, if the object's current position is to the left of a listener, the object can be mapped to one or more sound reproduction devices configured to play back sound emanating from a virtual sound source located or positioned to the left of the listener. As another example, if the object's metadata includes trajectory information that represents movement from the listener's left to the listener's right, the object can be initially mapped to one or more sound reproduction devices configured to play back sound emanating from a virtual sound source located or positioned to the left of the listener and then the object can be panned to one or more sound reproduction devices configured to play back sound emanating from a virtual sound source located or positioned to the right of the listener. Downmixing techniques can be used to smooth the transition of the object between the sound reproduction devices. For example, the object can be blended over two or more channels to create a position between sound reproduction devices. More complex rendering scenarios are possible, especially for rendering to surround sound channels. For instance, an object can be rendered on multiple channels or can be panned through multiple channels. Other effects besides panning can be performed in some implementations, such as adding delay, reverb, or any audio enhancement.

In some embodiments, VBAP-based rendering of an audio object uses a given configuration or positioning of sound reproduction devices. A renderer that uses VBAP accepts as input configuration or positioning of sound reproduction devices. Using this configuration and properties of an object, such as location, velocity, directivity, and the like, VBAP rendering can determine which sound reproduction devices are used to play back the audio of the object. For example, VBAP-based rendering can use the object's metadata to determine a region in which the audio object is positioned. The determined region can span sound reproduction devices. For example, the region can be a triangle having sound reproduction devices as vertices, and the audio of the object can be rendered on the sound reproduction devices corresponding to the vertices of the triangle. In certain embodiments, the region can be any suitable two-dimensional or three-dimensional region, such as a rectangle, square, trapezoid, ellipsis, circle, cube, cone, cylinder, and the like.

In some variations, the object is moving along trajectory between regions, and new regions corresponding to the object's position are determined as the object moves in space. When the object is moving, VBAP rendering can cause an abrupt transition of the object's sound from one sound reproduction device to another. Such transitions can be jarring to the listener (e.g., due to a zipping, clicking, or the like sound produced), and are hence undesirable. In order to reduce or eliminate these and other undesirable artifacts, VBAP-based rendering can determine non-overlapping regions. However, ambiguities may exist as to which region the object is currently positioned in. In other words, there may be more than one overlapping region where the object is positioned.

In some embodiments, ambiguities are resolved by identifying the overlapping regions, determining audio reproducing parameters for each of the overlapping regions, and combining the audio reproducing parameters. The combined audio reproducing parameters are used to play back the object's audio. In various embodiments, ambiguities are resolved by determining a position of a virtual sound reproduction device which is used to break up the overlapping regions into a plurality of non-overlapping regions. Audio reproducing parameters for non-overlapping regions are determined and are used to play back the object's audio.

II. Object-Based Audio Systems

By way of overview, FIG. 1 illustrates an embodiment of an object-based audio environment 100. The object-based audio environment 100 can enable content creator users to create and stream or transmit audio objects to receivers, which can render the objects without being bound to the fixed-channel model.

In the depicted embodiment, the object-based audio environment 100 includes an audio object creation system 110, a streaming module 122 implemented in a content server 120 (for illustration purposes), and receivers 140A, 140B. By way of overview, the audio object creation system 110 can provide functionality for content creators to create and modify audio objects. The streaming module 122, shown optionally installed on a content server 120, can be used to stream audio objects to the receiver 140A over a network 130. The network 130 can include a local area network (LAN), a wide area network (WAN), the Internet, or combinations of the same. The receivers 140A, 140B can be end-user systems that render received audio for output to one or more sound reproduction devices (not shown).

In the depicted embodiment, the audio object creation system 110 includes an object creation module 114 and an object-based encoder 112. The object creation module 114 can provide tools for creating objects, for example, by enabling audio data to be associated with attributes such as position, trajectory, velocity, and so forth. Any type of audio can be used to generate an audio object, including, for example, audio associated with movies, television, movie trailers, music, music videos, other online videos, video games, advertisements, and the like. The object creation module 114 can provide a user interface that enables a content creator user to access, edit, or otherwise manipulate audio object data. The object creation module 114 can store the audio objects in an object data repository 116, which can include a database, file system, or other data storage.

Audio data processed by the audio object creation module 114 can represent a sound source or a collection of sound sources. Some examples of sound sources include dialog, background music, and sounds generated by any item (such as a car, an airplane, or any moving, living, or synthesized thing). More generally, a sound source can be any audio clip. Sound sources can have one or more attributes that the object creation module 114 can associate with the audio data to create an object, automatically or under the direction of a content creator user. Examples of attributes include a location of the sound source, a velocity of a sound source, directivity of a sound source, trajectory of a sound source, downmix parameters to specific sound reproduction devices, sonic characteristics such as divergence or radiation pattern, and the like.

Some object attributes may be obtained directly from the audio data, such as a time attribute reflecting a time when the audio data was recorded. Other attributes can be supplied by a content creator user to the object creation module 114, such as the type of sound source that generated the audio (e.g., a car, an actor, etc.). Still other attributes can be automatically imported by the object creation module 114 from other devices. As an example, the location of a sound source can be retrieved from a Global Positioning System (GPS) device coupled with audio recording equipment and imported into the object creation module 114. Additional examples of attributes and techniques for identifying attributes are described in greater detail in U.S. application Ser. No. 12/856,442, filed Aug. 12, 2010, titled "Object-Oriented Audio Streaming System" ("the '442 application"). The systems and methods described herein can incorporate any of the features of the '442 application, and the '442 application is hereby incorporated by reference in its entirety.

The object-based encoder 112 can encode one or more audio objects into an audio stream suitable for transmission over a network or to another device. For example, the object-based encoder 112 can encode the audio objects as uncompressed LPCM (linear pulse code modulation) audio together with associated attribute metadata. The object-based encoder 112 can also apply compression to the objects when creating the stream. The compression may take the form of lossless or lossy audio bitrate reduction as may be used in disc and broadcast delivery formats, or the compression may take the form of combining certain objects with like spatial/temporal characteristics, thereby providing substantially the same audible result with reduced bitrate. In one embodiment, the audio stream generated by the object-based encoder includes at least one object represented by a metadata header and an audio payload. The audio stream can be composed of frames, which can each include object metadata headers and audio payloads. Some objects may include metadata only and no audio payload. Other objects may include an audio payload but little or no metadata, examples of which are described in the '442 application.

The audio object creation system 110 can supply the encoded audio objects to the content server 120 over a network (not shown). The content server 120 can host the encoded audio objects for later transmission. The content server 120 can include one or more machines, such as physical computing devices. The content server 120 can be accessible to receivers, such as the receiver 140A, over the network 130. For instance, the content server 120 can be a web server, an application server, a cloud computing resource (such as a virtual machine instance), or the like.

The receiver 140A can access the content server 120 to request audio content. In response to receiving such a request, the content server 120 can stream, upload, or otherwise transmit the audio content to the receiver 140A. The receiver 140A can be any form of electronic audio device or computing device, such as a desktop computer, laptop, tablet, personal digital assistant (PDA), television, wireless handheld device (such as a smartphone), sound bar, set-top box, audio/visual (AV) receiver, home theater system component, gaming console, combinations of the same, or the like.

In the depicted embodiment, the receiver 140A is an object-based receiver having an object-based decoder 142A and renderer 144A. The object-based receiver 140A can decode and play back audio objects in addition to or instead of decoding and playing audio channels. The renderer 144A can render or play back the decoded audio objects on one or more output sound reproduction devices (not shown). The receiver 144A effectively process the audio objects based on attributes encoded with the audio objects, which can provide cues on how to render the audio objects. For example, an object might represent a plane flying overhead with speed and position attributes. The renderer 144A can intelligently direct audio data associated with the plane object to different audio channels (and hence sound reproduction devices) over time based on the encoded position and speed of the plane. Another example of a renderer 144A is a depth renderer, which can produce an immersive sense of depth for audio objects. Embodiments of a depth renderer that can be implemented by the renderer 144A of FIG. 1 are described in U.S. application Ser. No. 13/342,743, filed Jan. 3, 2012, titled "Immersive Audio Rendering System," the disclosure of which is hereby incorporated by reference in its entirety.

It is also possible in some embodiments to effectively process objects based on criteria other than the encoded attributes. Some form of signal analysis in the renderer, for example, may look at aspects of the sound not described by attributes, but may gainfully use these aspects to control a rendering process. For example, a renderer may analyze audio data (rather than or in addition to attributes) to determine how to apply depth processing. Such analysis of the audio data, however, is made more effective in certain embodiments because of the inherent separation of delivered objects as opposed to channel-mixed audio, where objects are mixed together.

Although not shown, in one embodiment, the object-based encoder 112 is moved from the audio object creation system 110 to the content server 120. In such embodiment, the audio object creation system 110 can upload audio objects instead of audio streams to the content server 120. A streaming module 122 on the content server 120 could include the object-based encoder 112. Encoding of audio objects can therefore be performed on the content server 120. Alternatively, the audio object creation system 110 can stream encoded objects to the streaming module 122, which can decode the audio objects for further manipulation and later re-encoding.

By encoding objects on the content server 120, the streaming module 122 can dynamically adapt the way objects are encoded prior to streaming. The streaming module 122 can monitor available network 130 resources, such as network bandwidth, latency, and so forth. Based on the available network resources, the streaming module 122 can encode more or fewer audio objects into the audio stream. For instance, as network resources become more available, the streaming module 122 can encode relatively more audio objects into the audio stream, and vice versa.

The streaming module 122 can also adjust the types of objects encoded into the audio stream, rather than (or in addition to) the number. For example, the streaming module 122 can encode higher priority objects (such as dialog) but not lower priority objects (such as certain background sounds) when network resources are constrained. Features for adapting streaming based on object priority are described in greater detail in the '442 application, incorporated above. For example, object priority can be a metadata attribute that assigns objects a priority value or priority data that encoders, streamers, or receivers can use to decide which objects have priority over others.

From the receiver 140A point of view, the object-based decoder 142A can also affect how audio objects are streamed to the object-based receiver 140A. For example, the object-based decoder 142A can communicate with the streaming module 122 to control the amount and/or type of audio objects streamed to the receiver 140A. The object-based decoder 142A can also adjust the way audio streams are rendered based on the playback environment, as described in the '422 application.

In some embodiments, the adaptive features described herein can be implemented even if an object-based encoder (such as the encoder 112) sends an encoded stream to the streaming module 122. Instead of assembling a new audio stream on the fly, the streaming module 122 can remove objects from or otherwise filter the audio stream when computing resources or network resources are constrained. For example, the streaming module 122 can remove packets from the stream corresponding to objects that are relatively less important or lower priority to render.

In certain embodiments, object-based audio techniques can also be implemented in non-network environments. As is illustrated, object-based encoder 112 transmits audio objects to the receiver 140B over connection 150, which can be a wireless connection, wired connection, or a combination thereof. The receiver 140B can be any form of electronic audio device or computing device, such as a desktop computer, laptop, tablet, personal digital assistant (PDA), television, wireless handheld device (such as a smartphone), sound bar, set-top box, audio/visual (AV) receiver, home theater system component, gaming console, combinations of the same, or the like. The receiver 140B includes an object-oriented decoder 142B and render 144B which function as described above in connection with the decoder 144A and renderer 144A of the receiver 140A. For instance, the receiver 140B can be a gaming console that receives object-based audio from the audio object creation system 110. As another example, an object-based audio program can be stored on a computer-readable storage medium, such as a DVD disc, Blu-ray disc, a hard disk drive, or the like, and the receiver 140B can play back the object-based audio program stored on the medium. An object-based audio package can also be downloaded to local storage on the receiver 140B and then played back from the local storage.

It should be appreciated that the functionality of certain components described with respect to FIG. 1 can be combined, modified, or omitted. Additional examples of object-based audio environments are described in greater detail in U.S. application Ser. No. 13/415,667, filed Mar. 8, 2012, titled "System for Dynamically Creating and Rendering Audio Objects" ("the '667 application"). The systems and methods described herein can incorporate any of the features of the '667 application, and the '667 application is hereby incorporated by reference in its entirety.

III. Rendering Using VBAP

Figure 2:
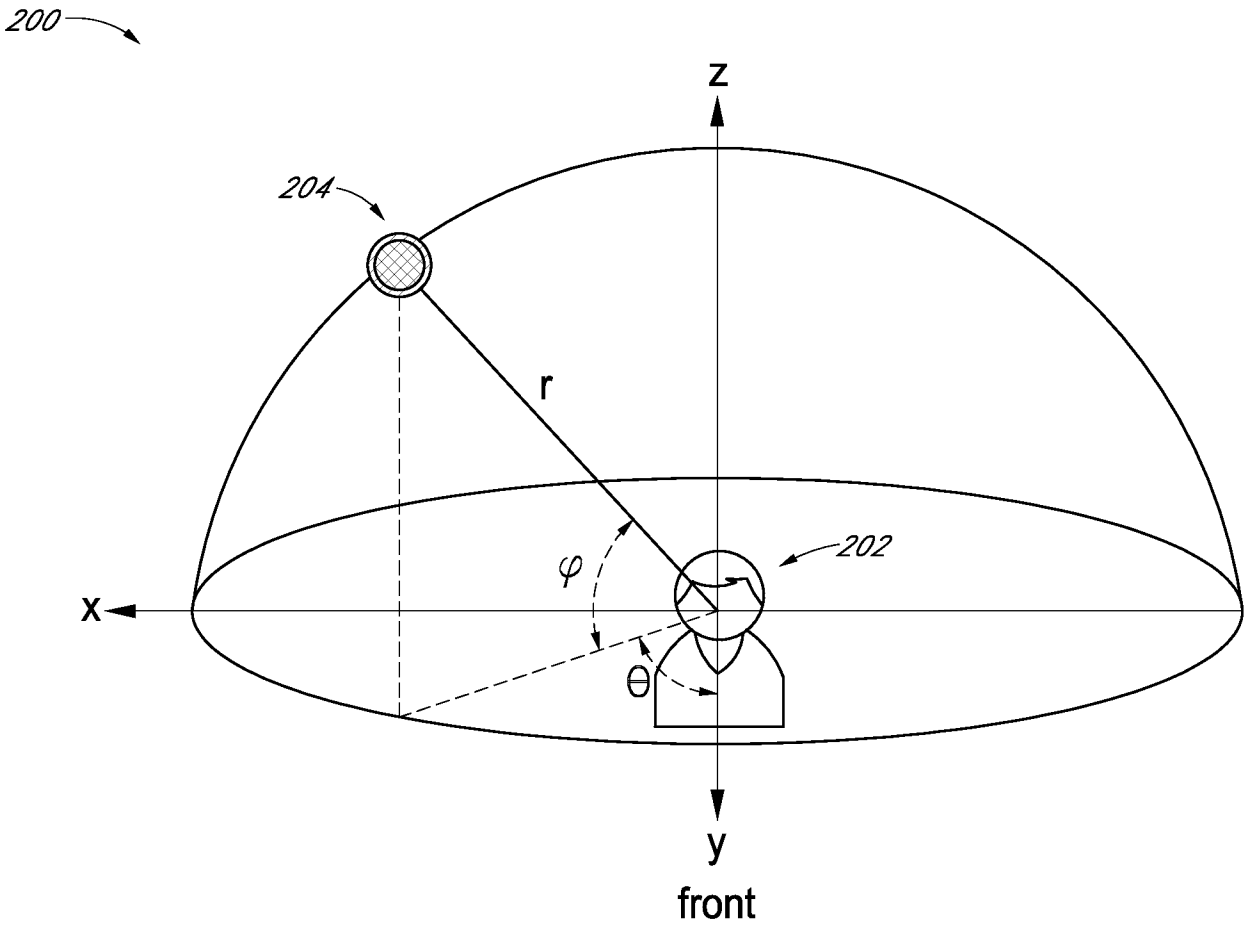
FIG. 2 illustrates an embodiment of object-based sound field.

In some embodiments, using VBAP allows rendering on any given configuration or positioning of sound reproduction devices one or more virtual sound sources from which audio corresponding to one or more objects emanates. FIG. 2 illustrates an embodiment of object-based sound field 200. As is illustrated, the sound field 200 can be represented as a hemisphere with the listener 202 is positioned in the center. A sound source 204, which can be a virtual sound source, is positioned in the sound field 200. As is illustrated, the sound source 204 is positioned on the surface of the hemisphere, the radius of which (r) is defined by the distance between the listener and one or more sound reproduction devices (illustrated in FIG. 3). The sound source 204 is positioned at coordinates (r, θ, ϕ) using notation according to the spherical coordinate system. Angle θ is the azimuth angle, ϕ is the elevation angle, and r is the distance of the sound source. In some embodiments, the sound field can be represented as any suitable two-dimensional or three-dimensional shape, such as a plane, circle, sphere, etc.

Figure 3:
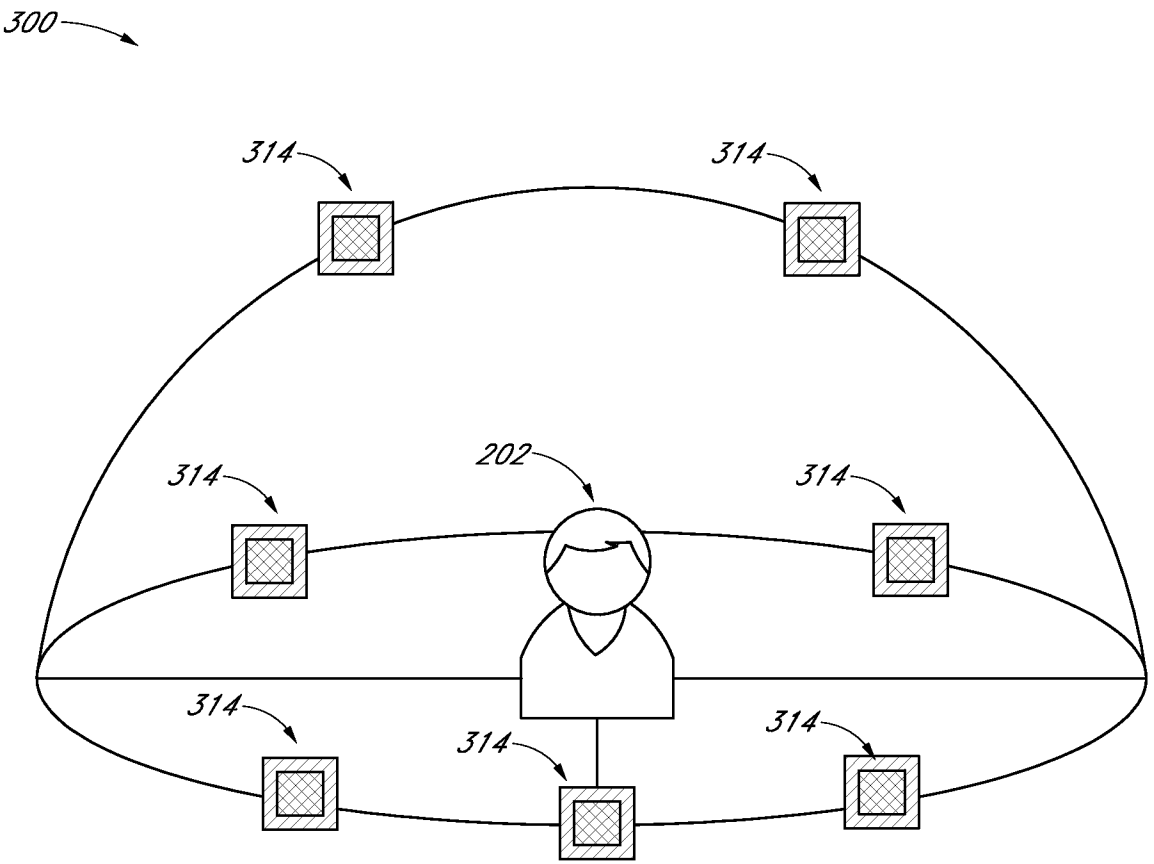
FIG. 3 illustrates an embodiment of a configuration of sound reproduction devices.

FIG. 3 illustrates an embodiment of a configuration or positioning 300 of sound reproduction devices. The illustrated hemisphere is defined by positioning of the sound reproduction devices 314 with respect to the listener 202. In one embodiment, the illustrated configuration 300 corresponds to 7.1 surround configuration (or 5.1 surround configuration plus two elevated or overhead speakers). Although loudspeakers 314 are illustrated, sound reproduction devices can be other suitable directional audio playback devices, such as directional headphones.

In some embodiments, VBAP is used to render or reproduce sound in the three-dimensional sound field 200 in which sound reproduction devices are positioned, such as for example, the configuration 300. As is illustrated in FIG. 3, sound reproduction devices 314 can be positioned on the surface of the hemisphere, with each sound reproduction device 314 being positioned equidistant (at distance defined by radius r) form the listener 202. In other words, the sound reproduction devices 314 are positioned on the surface of the hemisphere with the listener 202 being positioned at the center of the hemisphere.

Figure 4:
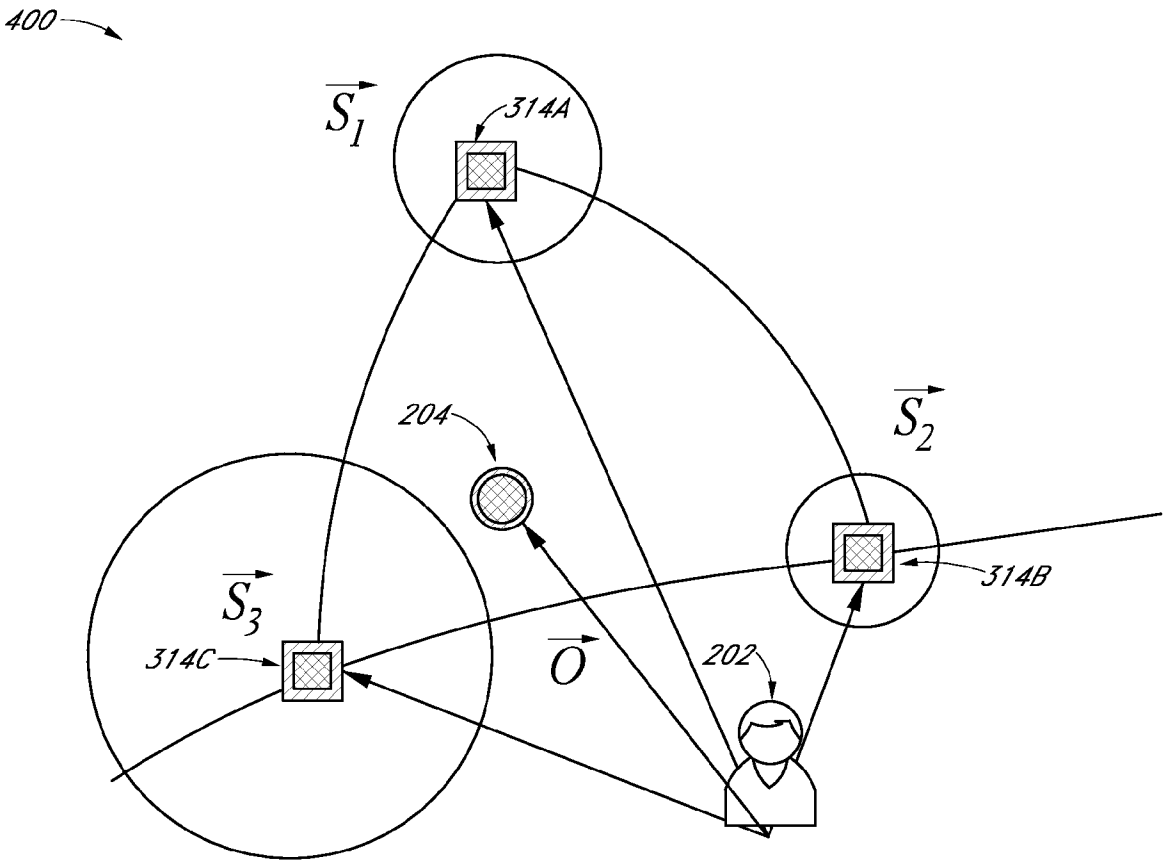
FIG. 4 illustrates an embodiment of an active triangle according to rendering based on Vector Base Amplitude Panning (VBAP).

Suppose that audio emanating from a virtual sound source positioned on the surface of the hemisphere is rendered. Using VBAP, an active triangle or active triangular patch in which the virtual sound source is positioned is determined. The vertices of the active triangle are made up of sound reproduction devices 314. FIG. 4 illustrates an embodiment of an active triangle 400 in which a virtual sound source 204 is positioned. The triangle 400 has sound reproduction devices 314A, 314B, and 314C as vertices. As is illustrated, sound reproduction devices 314B and 314C are located in the same plane as the listener 202, while sound reproduction device 314A is elevated and positioned overhead of the listener. Using VBAP, sound emanating from the virtual sound source 204 can be rendered on the sound reproduction devices 314A, 314B, and 314C. The sound source 204 is "virtual" because there is no physical sound reproduction device located at the position of the sound source. As is illustrated, the virtual sound source 204 is located overhead and behind the listener 202.

In some embodiments, vectors $\vec{S}_1$, $\vec{S}_2$, $\vec{S}_3$ are defined as directional vectors from the listener to the sound reproduction devices 314A, 314B, and 314C. These vectors define the direction of the sound reproduction devices. The direction of the virtual sound source 204 is defined by vector $\vec{O}$. Audio reproducing parameters for rendering audio emanating from the virtual sound source 204 can be determined for each of the sound reproduction devices 314A, 314B, and 314C. In one embodiment, VBAP can be used to determine gain factors for each of the sound reproduction devices 314A, 314B, and 314C as follows. Let vector $\vec{O}$ be expressed as:

$$\vec{O}=g_1\vec{S}_1+g_2\vec{S}_2+g_3\vec{S}_3 \quad (1)$$

where $g_1$, $g_2$, and $g_3$ are gain factors of the sound reproduction devices 314A, 314B, and 314C. These gain factors can be determined according to:

$$\vec{g}=\vec{O}M \quad (2)$$

with $$M=\begin{bmatrix} S_{11} & S_{12} & S_{13} \\ S_{21} & S_{22} & S_{23} \\ S_{31} & S_{32} & S_{33} \end{bmatrix}^{-1} \quad (3)$$

where $S_{ij}$ are components of the vectors $\vec{S}_1$, $\vec{S}_2$, $\vec{S}_3$ and $\vec{g}$ corresponds to gain factors $g_1$, $g_2$, and $g_3$ of the sound reproduction devices 314A, 314B, and 314C. Matrix M can be referred to as the basis matrix. The gain factors are determined by matrix inversion (equation 3) and matrix multiplication of directional vectors and the basis matrix (equation 2). In some embodiments, the sound reproduction devices are not positioned equidistant from the listener 202. That is, at least some sound reproduction devices are positioned at different distances from the listener.

In certain embodiments, VBAP-based rendering includes determining triangles or triangular patches from the configuration or positioning of sound reproduction devices. In addition, basis matrices corresponding to the triangles can be computed. These steps can be performed at system initialization or at runtime. An audio object is rendered by determining which triangle the direction vector of an audio object intersects. Such triangle is the active triangle, and gain factors are computed for the sound reproduction devices corresponding to the active triangle as explained above. The computed gain factors are applied to the object's audio during play back so as to vary the intensity of the sound reproduced by the sound reproduction devices. As the audio object moves along its specified trajectory, one or more new active triangles are determined, and gain factors are computed. In some embodiments, gain factors can be downmixed in order to smooth the transition of the object between one or more previous active triangles and a current active triangle. Gain factors can also be normalized to preserve power and scaled to introduce delay to account for sound reproduction device calibration.

Figure 5:
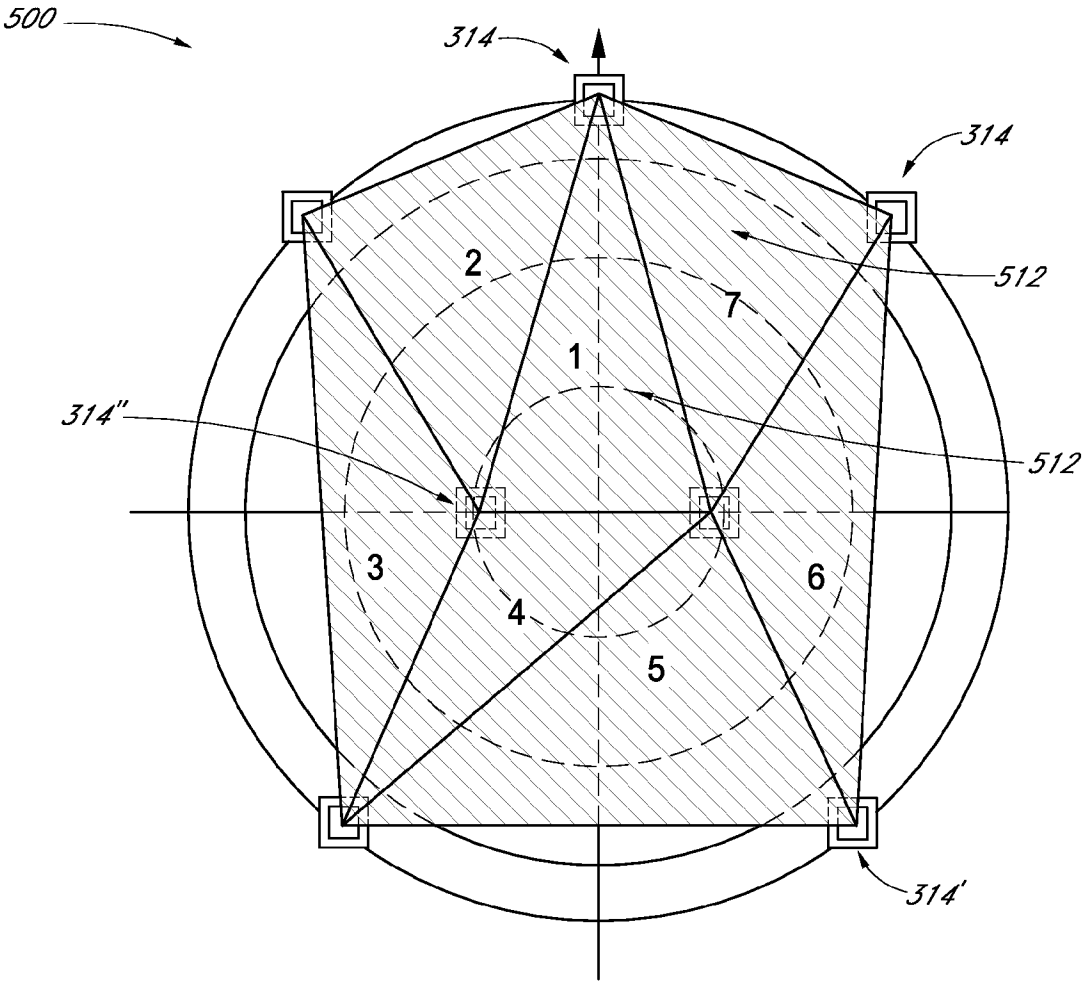
FIG. 5 illustrates an embodiment of a sound reproduction devices configuration with ambiguous triangles.

In some embodiments, non-overlapping triangles are determined or generated according to VBAP. Depending on a given configuration or positioning of the sound reproduction devices, ambiguities with determining triangles may arise. FIG. 5 illustrates an embodiment of a sound reproduction devices configuration 500 with ambiguous triangles. Sound reproduction devices 314 are positioned as illustrated, and triangles 512 are determined or generated. As is illustrated, triangles 1-7 have sound reproduction devices 314 as vertices. However, as is indicated the region spanning triangles 4 and 5 is ambiguous with respect to positioning of the sound source. For example, in this region triangles can be generated in at least two ways: 1) as is shown in FIG. 5 (e.g., triangles 4 and 5), or 2) by connecting the bottom right device 314' with the center device 314'), which overlap with triangles 4 and 5. If this ambiguity is not resolved, in certain embodiments, one or more jarring transition can be produced when an audio object moves from a position within triangle 4 to a position within triangle 5. In such case, reproducing the object's audio may be switched from a set of sound reproduction devices that does not include device 314' to a set of sound reproduction devices that includes device 314'.

In certain embodiments, ambiguous triangles can be identified automatically. For example, a triangle can be identified as ambiguous when the triangle spans an axis of symmetry but is not symmetrical with respect to the axis. The axis of symmetry can be vertical, horizontal, spatial, and the like. For instance, triangle 3 (which is not ambiguous) spans the horizontal axis of symmetry and is symmetrical with respect to the axis. In contrast, ambiguous triangles 4 and 5 span the vertical axis of symmetry but are not symmetrical with respect to the axis. Other suitable methods of identifying ambiguous triangles can be used instead of or in combination with the foregoing. In various embodiments, ambiguous triangles can be identified manually or partially manually.

IV. Resolving Ambiguities Associated with VBAP Rendering

Figure 6A:
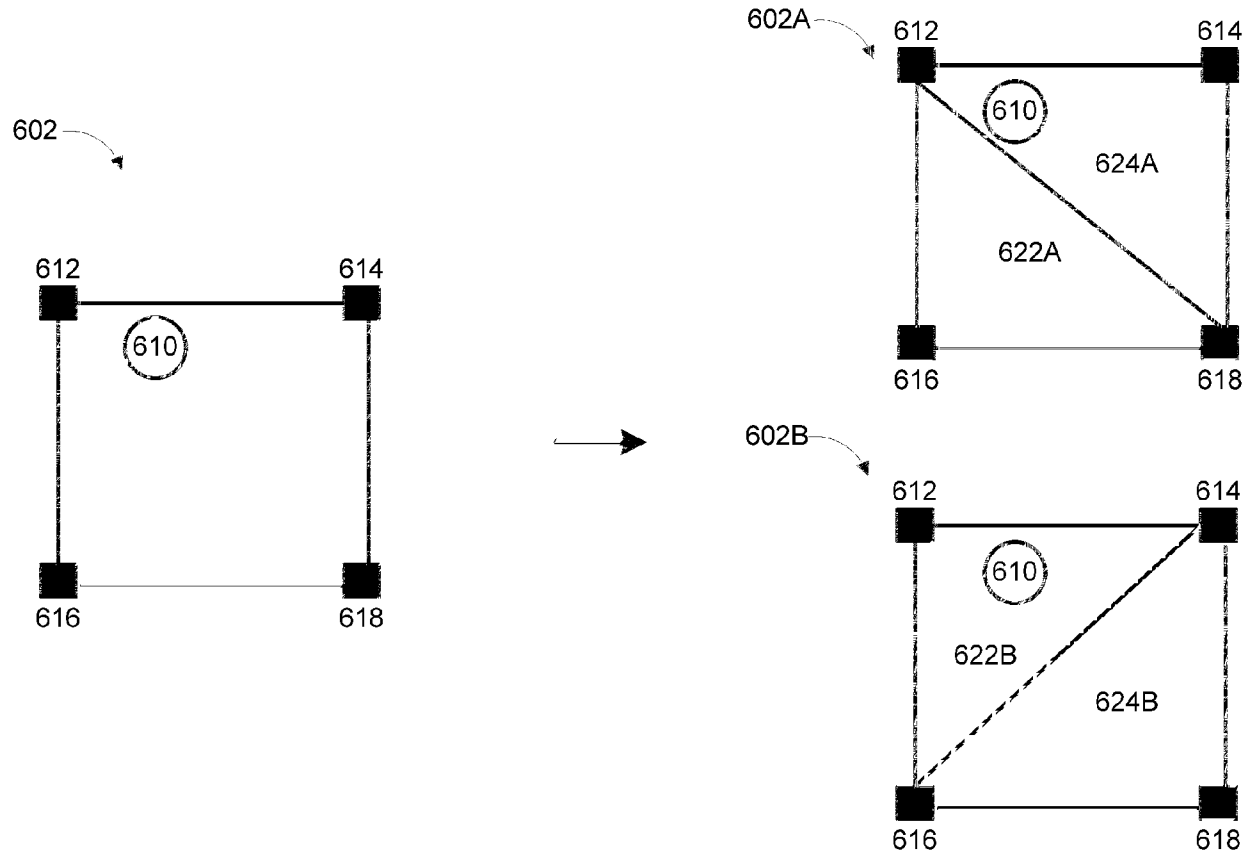
FIG. 6A illustrates an embodiment of resolving ambiguous triangles.

In some embodiments, instead of using any one triangle from a combination of ambiguous triangles, it is advantageous to take into account contributions due to more than one or all possible triangles. In certain embodiments, such approaches can advantageously provide smoothing and reduce jarring transitions. FIG. 6A illustrates an embodiment of resolving ambiguous triangles. As is shown, region 602 is made up of sound reproduction devices 612, 614, 616, and 618 as vertices of the region. Although region 602 is illustrated as a square, the region can be of any shape, such as rectangle, trapezoid, and the like. 610 depicts location of a virtual sound source corresponding to audio object's location in space at a given time. As is illustrated in 602A and 602B, region 602 can be divided into triangles 622A and 624A by connecting devices 612 and 618 or into triangles 622B and 624B by connecting devices 614 and 616. This indicates an ambiguity as the virtual sound source 610 can be located either within triangle 624A or 622B, which are overlapping. It may be advantageous to render or play back object's audio using all four sound reproduction devices 612, 614, 616, and 618, rather than picking a triangle from the set of ambiguous triangles and playing back object's audio using only three sound reproduction devices corresponding to the vertices of the selected triangle.

In the illustrated embodiment, the ambiguity is resolved by determining audio reproducing parameters corresponding to the vertices of triangles 624A and 622B where the virtual sound source 610 is positioned. For example, gain factors for the two triangles can be computed using equation (2) as explained above. The computed gains factors can be combined for reproducing or playing back object's audio so that it appears to emanate from the virtual sound source 610. In the illustrated embodiment, sound reproduction devices 612, 614, 616, and 618 are utilized to play back the object's audio. In some embodiments, the computed gain factors for triangles 624A and 622B can be averaged. In other embodiments, any suitable combination can be utilized, such as median, covariance, or the like.

Figure 6B:
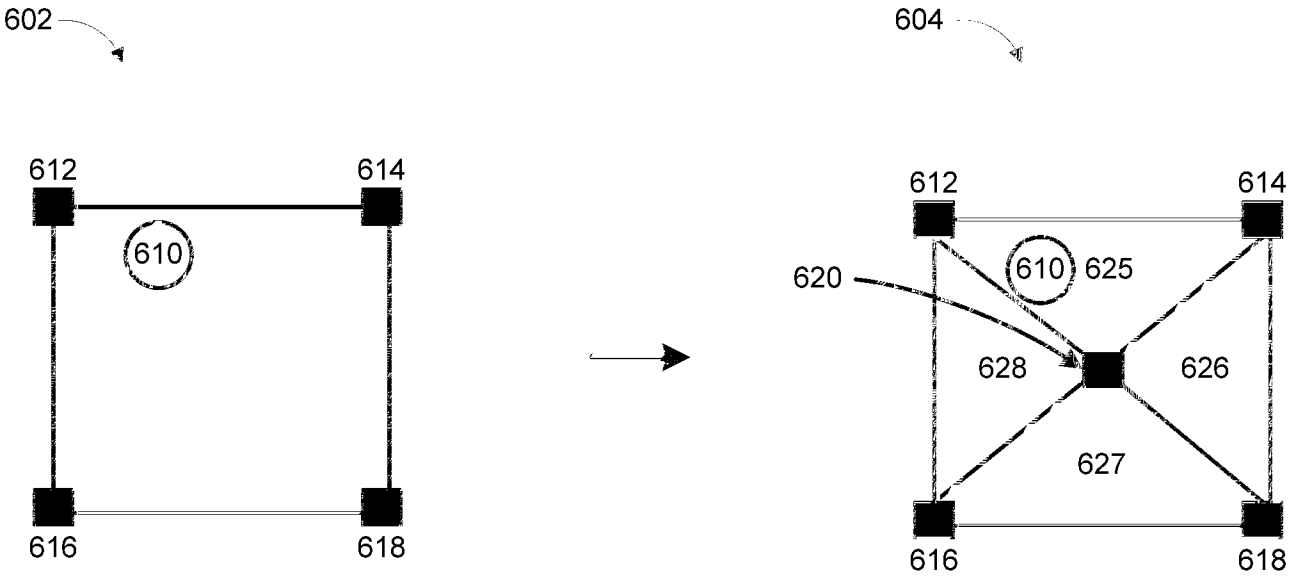
FIG. 6B illustrates another embodiment of resolving ambiguous triangles.

FIG. 6B illustrates another embodiment of resolving ambiguous triangles. As is shown, region 602 is made up of physical sound reproduction devices 612, 614, 616, and 618 as vertices of the region, and 610 depicts location of the virtual sound source 610. As is illustrated and explained above, region 602 can be divided into two triangles by connecting devices 612 and 618 or into different two triangles by connecting devices 614 and 616. This indicates an ambiguity as the virtual sound source 610 can be located either within two distinct overlapping triangles.

Figure 6C:
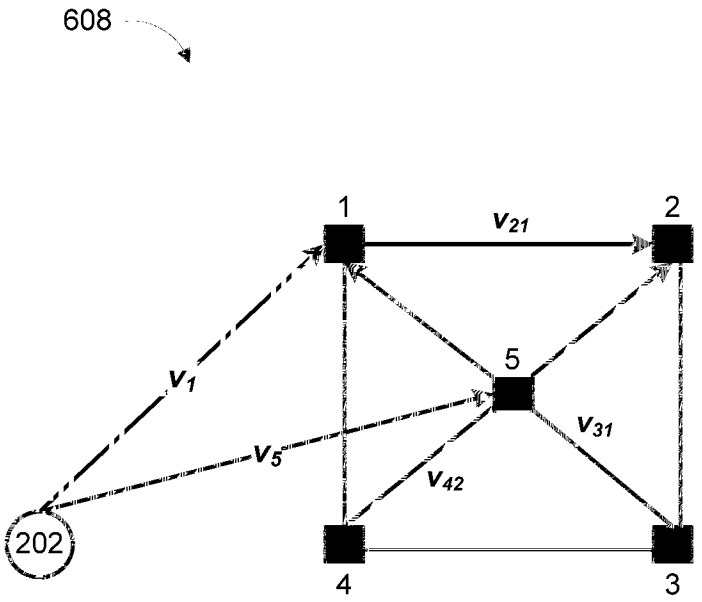
FIG. 6C illustrates an embodiment of determining location of a virtual sound reproduction device.

As is illustrated, a virtual sound reproduction device 620 can be positioned at the intersection of two sides of the overlapping triangles. FIG. 6C illustrates an embodiment of determining the location of a virtual sound reproduction device 5. As is illustrated, region 608 is made up of physical sound reproduction devices 1, 2, 3, and 4 as vertices of the region, and 202 depicts the listener. Position of the virtual sound reproduction device 5 is determined according to solving the following system of equations:

$$\begin{cases} \overrightarrow{v_5} = \overrightarrow{v_1} + k\overrightarrow{v_{31}} \\ \overrightarrow{v_2} + k'\overrightarrow{v_{42}} = \overrightarrow{v_1} + k'\overrightarrow{v_{31}} \end{cases} \tag{4}$$

where $\overrightarrow{v}_i$ are vectors as depicted in FIG. 6C and k, k' are constants. Directional vector $\overrightarrow{v}_5$ from the listener to the virtual sound reproduction device 5 is determined according to (where Λ indicates cross product and • indicates dot product):

$$\overrightarrow{v_5} = \overrightarrow{v_1} + \frac{(\overrightarrow{v_{21}} \wedge \overrightarrow{v_{42}}) \cdot (\overrightarrow{v_{31}} \wedge \overrightarrow{v_{42}})}{|\overrightarrow{v_{31}} \wedge \overrightarrow{v_{42}}|^2}\overrightarrow{v_{31}} \tag{5}$$

Returning to FIG. 6B, once the position of the virtual sound reproduction device 620 has been determined, the region can be split into four triangles 625, 626, 627, and 628 as illustrated. The four non-overlapping triangles 625, 626, 627, and 628 have as vertices two physical sound reproduction devices and the virtual sound reproduction device 620. The current position of the virtual sound source 610 is determined to be in triangle 625, and audio reproducing parameters, such as gain factors, can be determined for the triangle 625 according to equation (2) as described above. In some embodiments, more than one virtual sound reproduction device can be used.

In certain embodiments, the gain factors for each of the four triangles 625, 626, 627, and 628, which are determined according to equation (2) as described above, can be combined to reproduce audio emanating from the virtual sound source 610 using the sound reproduction devices 612, 614, 616, and 618. In one embodiment, the combined gain factors are determined as follows. Suppose that in FIG. 6B sound reproduction device 612 is labeled as "1", device 614 is labeled as "2," device 618 is labeled as "3," device 616 is labeled as "4," and virtual sound reproduction device 620 is labeled as "5" (see FIG. 6C). Because the virtual sound source 610 is located in two overlapping triangles with vertices {1, 2, 4} and vertices {1, 2, 3}, the gain factors conform to the following relationship:

$$\overrightarrow{g} = \overrightarrow{g^{124}} + \overrightarrow{g^{123}}) \tag{6}$$

As explained above, the direction of the virtual sound source 204 is defined as vector $\overrightarrow{O}$ and vectors $\overrightarrow{S}_1$, $\overrightarrow{S}_2$, $\overrightarrow{S}_3$ are defined as directional vectors from the listener to the sound reproduction devices. Vector $\overrightarrow{O}$ can be determined according to:

$$\overrightarrow{O} = g_1^{125}\overrightarrow{S_1} + g_2^{125}\overrightarrow{S_2} + g_5^{125}\overrightarrow{S_5} \tag{7}$$

Solving for the gain factors $g_1$, $g_2$, $g_3$, and $g_4$ of the sound reproduction devices 612, 614, 618, and 616 respectively provides:

$$\begin{cases} \overrightarrow{O} = (g_1^{125} + g_5^{125}\gamma_1^{123})\overrightarrow{S_1} + (g_2^{125} + g_5^{125}\gamma_2^{123})\overrightarrow{S_2} + g_5^{125}\gamma_3^{123}\overrightarrow{S_3} \\ \overrightarrow{O} = (g_1^{125} + g_5^{125}\gamma_1^{124})\overrightarrow{S_1} + (g_2^{125} + g_5^{125}\gamma_2^{124})\overrightarrow{S_2} + g_5^{125}\gamma_4^{124}\overrightarrow{S_4} \end{cases} \tag{8}$$

$$\text{since} \begin{cases} \overrightarrow{S_5} = \gamma_1^{124}\overrightarrow{S_1} + \gamma_2^{124}\overrightarrow{S_2} + \gamma_4^{124}\overrightarrow{S_4} \\ \overrightarrow{S_5} = \gamma_1^{123}\overrightarrow{S_1} + \gamma_2^{123}\overrightarrow{S_2} + \gamma_3^{123}\overrightarrow{S_3} \end{cases} \tag{9}$$

$$\text{comparing to} \begin{cases} \overrightarrow{O} = g_1^{123}\overrightarrow{S_1} + g_2^{123}\overrightarrow{S_2} + g_3^{123}\overrightarrow{S_3} \\ \overrightarrow{O} = g_1^{124}\overrightarrow{S_1} + g_2^{124}\overrightarrow{S_2} + g_4^{124}\overrightarrow{S_4} \end{cases} \tag{10}$$

$$\begin{cases} g_1 = 2g_1^{125} + g_5^{125}\gamma_1^{123} + g_5^{125}\gamma_1^{124} \\ g_2 = 2g_2^{125} + g_5^{125}\gamma_2^{123} + g_5^{125}\gamma_2^{124} \\ g_3 = g_5^{125}\gamma_3^{123} \\ g_4 = g_5^{125}\gamma_4^{124} \end{cases} \tag{11}$$

where $\gamma_i$ is the elevation angle of the sound reproduction source i (e.g., γ corresponds to the elevation angle ϕ as is illustrated in FIG. 2). Accordingly, gain factors $g_1$, $g_2$, $g_3$, and $g_4$ of the sound reproduction devices 612, 614, 618, and 616 are determined using the gain factors determined for the triangles 625 through 628. Gain factors $g_1$, $g_2$, $g_3$, and $g_4$ can be used to play back object's audio on the sound reproduction devices 612, 614, 616, and 618. In one embodiment, object's audio emanating from the virtual source 610 can be played back using the two physical sound reproduction devices 612 and 614 of the triangle 625.

In some embodiments, gain factors used for rendering object's audio so that it emanates from a virtual sound source can be pre-computed at initialization and used at runtime when objects are rendered. This is particularly applicable to the embodiment illustrated in FIG. 6B. For the illustrated embodiment, because triangles determined for placing one or more virtual sound reproduction devices are small, the directional vector $\overrightarrow{O}$ from the listener to the virtual sound source positioned in such triangles can be deemed to be stationary, and gain factors computed according to equation (2) for the triangles which include the one or more virtual sound reproduction devices can also be deemed to be stationary. Accordingly, combined gain factors computed according to equation (11) can be precomputed at system initialization. In certain embodiments, gain factors can be computed or recomputed at runtime. For example, for the embodiment illustrate in FIG. 6A, gain factors for the triangles 624A and 622B can be computed at runtime based on the directional vector $\overrightarrow{O}$, and the combined gain factors for the sound reproduction devices 612 through 618 can be determined.

Although ambiguities with respect to two overlapping regions, such as triangles, are illustrated, more than two regions may be overlapping. Systems and methods disclosed herein can be applied to resolve such ambiguities.

Figure 7:
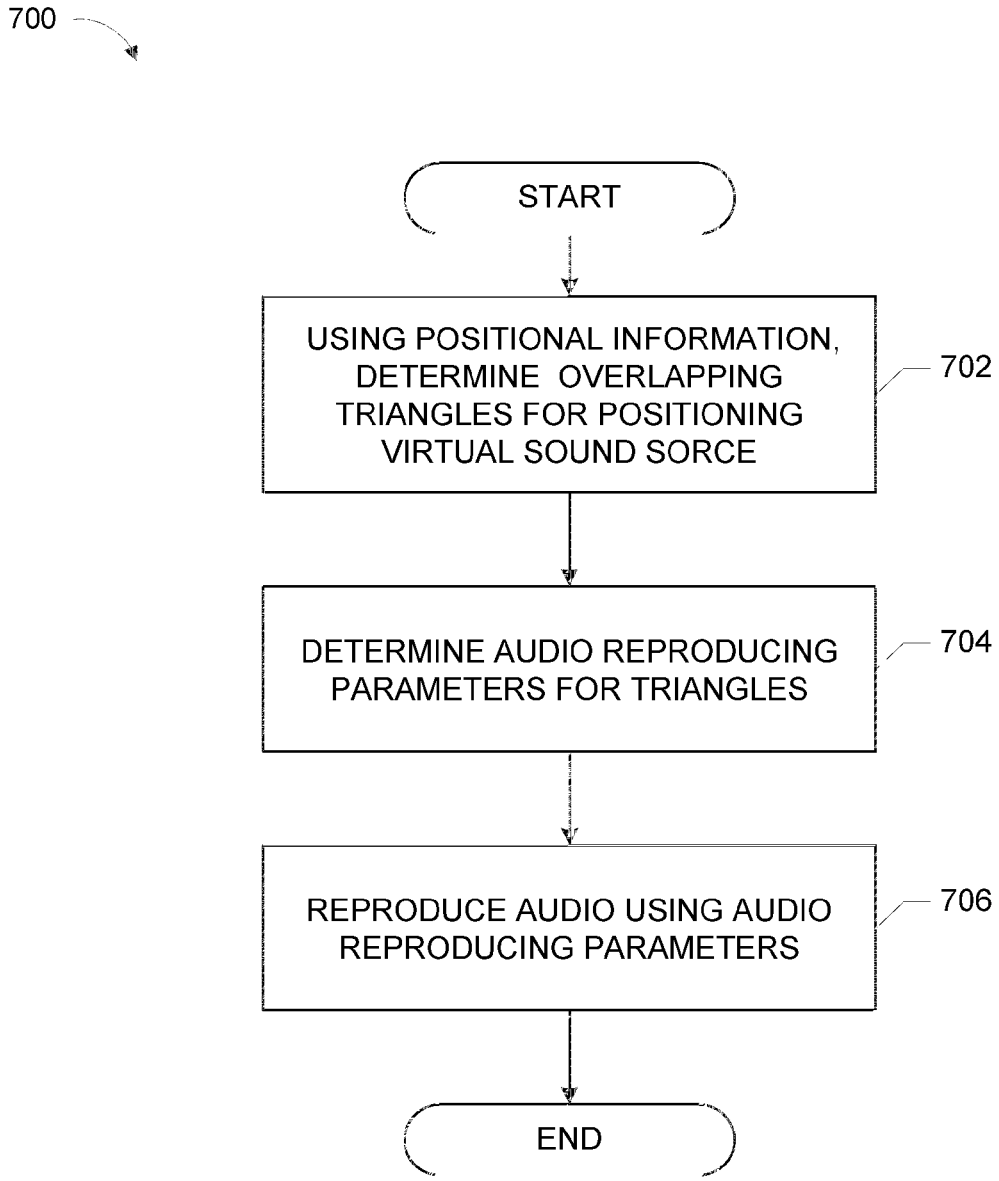
FIG. 7 illustrates an embodiment of a method of resolving ambiguous triangles.

FIG. 7 illustrates an embodiment of a method 700 of resolving ambiguous triangles. The method 700 can be implemented by the receiver 140A, 140B. In block 702, the method 700 determines, based on a current position of an object, triangles for positioning a virtual sound source. These triangles can be overlapping, and the method 700 can resolve the ambiguity according to the foregoing explanation. In block 704, the method 700 determines audio reproducing parameters for the triangles, which can be performed using equation (2) as described above. In block 706, the method 700 reproduces the object's audio on the sound reproduction devices so that the audio appears to emanate from a virtual sound source located at the object's current position.

V. Gaming Application

Figure 8:
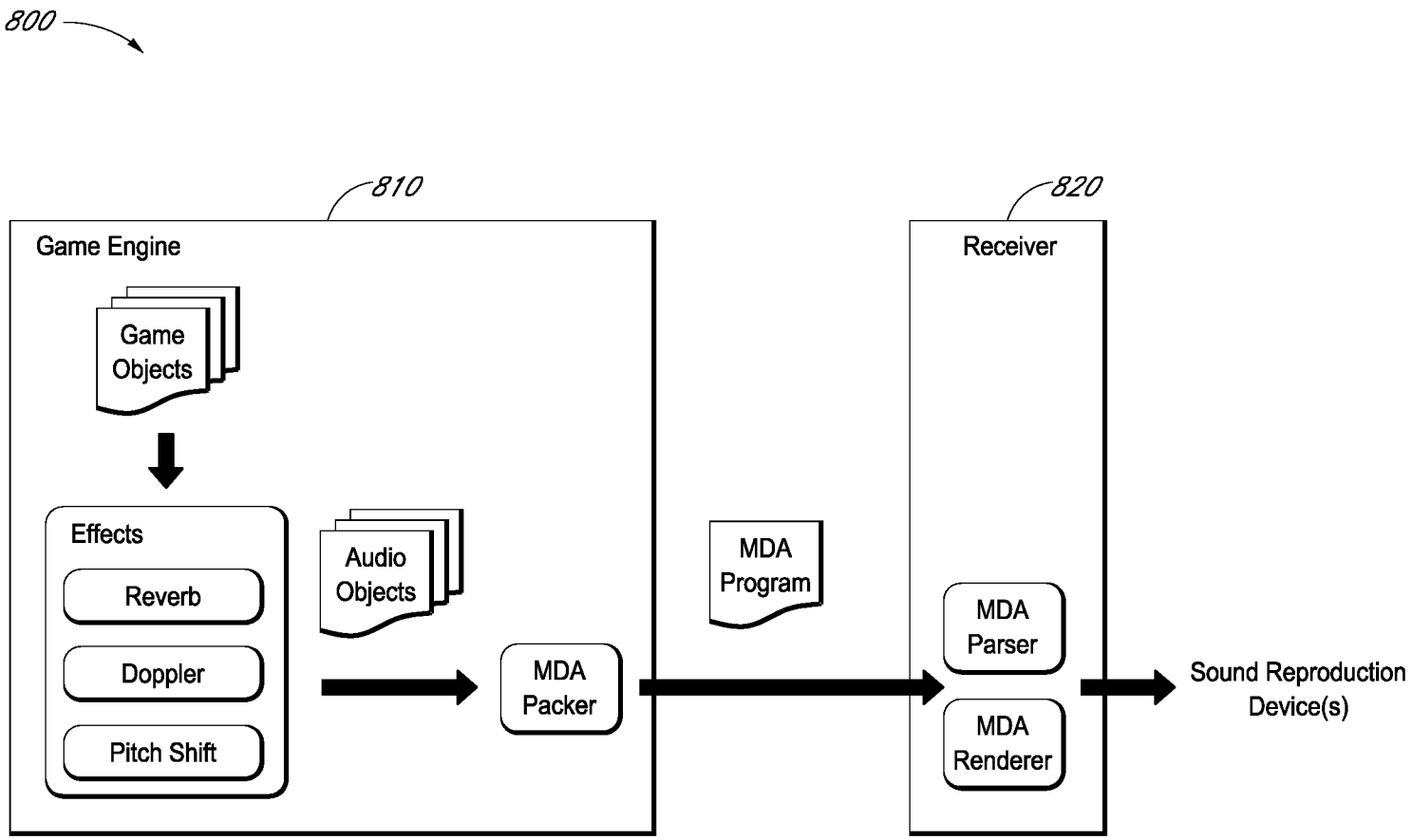
FIG. 8 illustrates an embodiment of an object-based audio system used for gaming.

FIG. 8 illustrates an embodiment of an object-based audio system 800 used for gaming. As is illustrated, gaming device or game engine 810 is configured to create audio objects as explained above. The created objects can correspond to audio for a video game. Audio objects are transmitted to a receiver 820 over a transmission channel, which can be wired or wireless channel. For example, the channel can be HDMI, DLNA, etc. The receiver 820 is configured to decode audio objects and reproduce the audio on one or more sound reproduction devices. The receiver can reproduce audio associated with the objects using modified VBAP rendering described above. The gaming device 810 can be located in the proximity of the receiver 820, such as in the same room, same building, etc.

In one embodiment, the receiver 820 is configured to accept a description of the playback system configuration including the layout of sound reproduction devices (e.g., physical speakers) in the listening environment, whereas the game engine 810 need not be aware of the playback system configuration. This can simplify the task of the creator or programmer of the game application running on the game engine 810, who can deliver a single program suitable for all possible audio playback configurations, including headphones, sound bar loudspeakers, or any multi-channel loudspeaker geometry. For example, game engine 810 need not be aware of the positioning of the sound reproduction devices with respect to the listener.

VI. Terminology

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. For example, the receivers 140A and 140B can be implemented by one or more computer systems or by a computer system including one or more processors. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a personal organizer, a device controller, and a computational engine within an appliance, to name a few.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. A storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A method of reproducing object-based audio, the method comprising:

for a plurality of sound reproduction devices, determining one or more audio reproducing parameters for reproducing an audio object by:

determining a position of a virtual sound source for the audio object;

determining a first plurality of triangles in which the virtual sound source is positioned, each of the vertices of each triangle in the first plurality of triangles corresponding to a physical sound reproduction device of a plurality of sound reproduction devices, the sound reproduction devices being separate from the virtual sound source;

determining a position of a virtual sound reproduction device separate from the virtual sound source;

partitioning the first plurality of triangles into a second plurality of triangles, each triangle in the second plurality of triangles comprising two vertices corresponding to selected ones of the physical sound reproduction devices from the first plurality of triangles and one vertex corresponding to the virtual sound reproduction device;

determining a plurality of audio reproducing parameters for a set of sound reproduction devices corresponding to the vertices of the second plurality of triangles; and applying the audio reproducing parameters to the audio object to cause an audio signal to be output on at least some of the physical sound reproduction devices;

wherein the method is performed by one or more processors.

2. The method of claim 1, further comprising:

receiving, with a receiver comprising one or more processors, the audio object comprising audio; and using the one or more audio reproducing parameters, reproducing the audio on the set of sound reproduction devices such that the audio appears to emanate from the virtual sound source.

3. The method of claim 2, wherein the second plurality of triangles comprises four triangles, each having the virtual sound reproduction device as a vertex, and determining the one or more audio reproducing parameters comprises determining gain factors corresponding to the vertices of the four triangles.

4. The method of claim 3, wherein determining the gain factors corresponding to the vertices of the four triangles comprises combining the gain factors for each of the triangles to determine the gain factors corresponding to the non-virtual vertices of the four triangles, and reproducing the audio on the set of sound reproduction devices comprises playing back the audio on the sound reproduction devices corresponding to non-virtual vertices of the triangles.

5. The method of claim 1, wherein at least some triangles in the first plurality of triangles are overlapping, and the triangles in the second plurality of triangles are not overlapping.

6. The method of claim 1, wherein determining the position of the virtual sound reproduction device comprises determining an intersection point of the sides of two triangles in the first plurality of triangles.

7. An apparatus for reproducing object-based audio, the apparatus comprising:

a renderer comprising one or more processors, the renderer configured to:

determine a position of a virtual sound source for the audio object;

determine a first plurality of triangles in which the virtual sound source is positioned, each of the vertices of each triangle in the first plurality of triangles corresponding to a physical sound reproduction device of a plurality of sound reproduction devices, the sound reproduction devices being separate from the virtual sound source;

determine a position of a virtual sound reproduction device;

partitioning the first plurality of triangles into a second plurality of triangles, the vortices of each triangle in the second plurality of triangles comprising two vertices corresponding to selected ones of the physical sound reproduction devices from the first plurality of triangles and one vertex corresponding to the virtual sound reproduction device;

determine one or more audio reproducing parameters for a set of sound reproduction devices corresponding to the vertices of the second plurality of triangles; and applying the audio reproducing parameters to the audio object to cause an audio signal to be output on at least some of the physical sound reproduction devices.

8. The apparatus of claim 7, further comprising a receiver configured to receive the audio object comprising audio, wherein the renderer is further configured to reproduce the audio, using the one or more audio reproducing parameters, on the set of sound reproduction devices such that the audio appears to emanate from the virtual sound source.

9. The apparatus of claim 8, wherein the second plurality of triangles comprises four triangles, each having the virtual sound reproduction device as a vertex, and the renderer is configured to determine the one or more audio reproducing parameters by determining gain factors corresponding to the vertices of the four triangles.

10. The apparatus of claim 9, wherein the renderer is further configured to determine the gain factors corresponding to the non-virtual vertices of the four triangles by combining the gain factors for each of the triangles, and play back the audio on the sound reproduction devices corresponding to non-virtual vertices of the triangles.

11. The apparatus of claim 7, wherein at least some triangles in the first plurality of triangles are overlapping, and the triangles in the second plurality of triangles are not overlapping.

12. The apparatus of claim 7, wherein the renderer is further configured to determine the position of the virtual sound reproduction device by determining an intersection point of the sides of two triangles in the first plurality of triangles.

13. An apparatus for reproducing object-based audio, the apparatus comprising:

one or more hardware processors that:

receive an audio object comprising an audio signal and metadata;

identify a position of a virtual sound source in the audio signal represented by the metadata of the audio object;

identify a triangle of a plurality of triangles intersected by a direction vector of the virtual sound source, the plurality of triangles defined by physical speakers and a virtual speaker at a location among the physical speakers other than a location of the virtual sound source, each of the triangles having two vertices defined by two of the physical speakers and a third vertex defined by the virtual speaker;

access a plurality of gain values mapped to the position of the virtual sound source within the identified triangle intersected by the direction vector of the virtual sound source; and apply the plurality of gain values to the audio object to cause an audio signal associated with the audio object to be output at varying levels of intensity by at least some of the physical speakers.

14. The apparatus of claim 13, wherein the physical speakers comprise four physical speakers.

15. The apparatus of claim 13, wherein the physical speakers comprise speakers other than front speakers.

16. The apparatus of claim 13, wherein at least some of the plurality of gain values are pre-computed.

17. The apparatus of claim 16, wherein at least some of the plurality of gain values are computed subsequent to the identification of the position of the virtual sound source.

18. The apparatus of claim 13, wherein the plurality of triangles comprises four triangles, each having the virtual sound reproduction device as a vertex, and wherein the one or more hardware processors accesses the plurality of gain values by determining the gain values corresponding to the vertices of the four triangles.

19. The apparatus of claim 18, wherein the one or more hardware processors determines the gain values by combining gain factors for each of the triangles to determine the gain values corresponding to the non-virtual vertices of the four triangles.

* * * * *

UNITED STATES PATENT AND TRADEMARK OFFICE

CERTIFICATE OF CORRECTION

PATENT NO. : 9,197,979 B2
APPLICATION NO. : 13/906214
DATED : November 24, 2015
INVENTOR(S) : Pierre-Anthony Stivell Lemieux It is certified that error appears in the above-identified patent and that said Letters Patent is hereby corrected as shown below:

Claims

In column 18 at line 7, In Claim 7, after "triangles," delete "the vortices of".

Signed and Sealed this
Twenty-fourth Day of May, 2016

Michelle K. Lee

Michelle K. Lee
*Director of the United States Patent and Trademark Office*